United States Patent [19]

Fuller

[11] 4,124,982

[45] Nov. 14, 1978

[54] METHOD OF STABILIZING SOIL IN PILE BEARING REGIONS

[75] Inventor: Francis M. Fuller, Houston, Tex.

[73] Assignee: Raymond International Inc., Houston, Tex.

[21] Appl. No.: 725,497

[22] Filed: Sep. 22, 1976

[51] Int. Cl.[2] ..... E02D 3/10

[52] U.S. Cl. ..... 405/232; 405/267; 405/36

[58] Field of Search ..... 61/36 R, 50, 10, 11, 61/35, 53

[56] References Cited

U.S. PATENT DOCUMENTS

| | | | |
|---|---|---|---|
| 464,771 | 12/1891 | Harris | 61/36 R |
| 1,215,134 | 2/1917 | Ferry | 61/36 R |
| 1,846,815 | 2/1932 | Sichardt et al. | 61/50 |
| 2,101,358 | 12/1937 | Boardman | 61/50 |

FOREIGN PATENT DOCUMENTS

| | | | |
|---|---|---|---|
| 980,708 | 1/1965 | United Kingdom | 61/50 |

*Primary Examiner*—Mervin Stein
*Assistant Examiner*—David H. Corbin
*Attorney, Agent, or Firm*—Fitzpatrick, Cella, Harper & Scinto

[57] ABSTRACT

Soil having liquefaction potential in a load bearing region is stabilized by the placement of load supporting pile means in the region and the placement of water impervious means in the region, the water impervious means extending to a depth at least equal to that of the soil having liquefaction potential to facilitate dewatering of the region and to prevent the entry of ground water thereinto.

6 Claims, 9 Drawing Figures

METHOD OF STABILIZING SOIL IN PILE BEARING REGIONS

BACKGROUND OF THE INVENTION

1. Field of the Invention

This invention relates to a method of stabilizing soil in pile bearing regions, especially in such regions which have liquefaction potential, and to a load supporting structure formed in such regions.

2. Description of the Prior Art

It is known that regions of loose, water-bearing, granular soils can liquify to depths of the order of fifty feet if subjected to seismic shock, such as is caused by earthquake or severe artificial earth vibration, and that in the event of such an occurrance, load bearing piles positioned in such regions can lose the support of the soil, both in bearing capacity and laterally. While the potential loss of bearing capacity in such regions is not too serious because piles can be driven to a depth below such regions to assure the required capacity, the potential loss of lateral support of the soil can be quite serious, indeed catastrophic. Thus, serious seismic disturbances involve both vertical and horizontal ground movement, the latter tending to cause lateral movement of a supported structure. Such movement, coupled with the structure's momentum, can induce very high lateral loads on the piles. Moreover, if liquefaction occurs, the passive soil pressures that help resist lateral displacement of the piles under lateral loads would greatly decrease thus causing extremely high bending moments in the piles so that very heavy or stiff piles would be required to resist such forces; and, upon loss of lateral soil support, the piles may tend to buckle under axial loads.

Another possible difficulty is the loss of frictional capacity of the upper portions of the piles due to loss of shear strength of the soil upon liquefaction of an upper soil stratum. Such a condition would transfer the structural loads to the lower portions of the piles with greater loads transferred to the lower bearing soil. This may result in overstressing of the piles, the lower soil, or both and may cause settlement of friction type piles.

In the construction of heavy structures in areas of soils having substantial water content, especially as it affects the construction of facilities such as power plants, the general procedure is to install a temporary well-point system so as to dewater the site and permit excavation in the dry. After completion of construction, the well-point system is removed and no further attempt is made to control ground water level. In one case of which I am aware, the ground water control system involved dewatering and water injection means to lower or raise the ground water level and was installed as a permanent system so as to control and regulate hydrostatic pressure beneath a foundation slab underlying the structure so as to maintain the load structure at a constant level. This procedure is expensive and time consuming and may still allow for liquefaction upon the occurrence of seismic shock.

SUMMARY OF THE INVENTION

The present invention is directed to a method and structure by which the foregoing difficulties and disadvantages are overcome. Thus, I contribute a method of stabilizing soil having liquefaction potential in a pile bearing region, according to which method, load supporting pile means are placed in a region of soil having liquefaction potential and water impervious means are placed around the region to surround the pile means and to a depth at least equal to the depth of the soil having liquefaction potential to facilitate dewatering of the region and to prevent or control the entry of ground water into the region, although it is preferred that the impervious means be so placed as to extend into a water impermeable stratum, if practical. The water impervious means may be a chemical grout placed in position by injection.

According to another concept related to the foregoing contribution, load supporting pile means are placed in such a region, endless wall means are formed in the region and to a depth at least equal to the depth of the soil having liquefaction potential to confine the region therewithin and to resist the flow of ground water into the region, and water is removed from within the confines of the wall means substantially to dewater the region to a degree sufficient to eliminate the liquefaction potential therein. Again, penetration of some water impermeable stratum by the endless wall is preferred, if practical.

The pile means are placed in the region perferably at least to a level of soil having substantially no liquefaction potential.

Another aspect of the invention contemplates the positioning of monitoring means and water withdrawing means in the region to monitor the amount of water in the region and to withdraw water therefrom when the amount of water therein exceeds a predetermined level or quantity thus to maintain the region free of liquefaction potential. The monitoring means may in fact be employed automatically to control the water withdrawing means. In this connection it is important to note that soil conditions that are ideal for liquefaction are also ideal for water removal. Thus, depending on conditions, suction wells or deep well pumping systems may be employed for water removal. If a particular installation is effective permanently to exclude ground water, the dewatering system can be removed after the confined water is removed, otherwise the system is permanent and is operated whenever the ground water reaches a predetermined critical level or quantity.

It will be understood that, depending on circumstances, such as pile disposition, the wall means may consist of a single endless wall confining the region and all of the piles in the region or a wall around respective subdivisions of the region and therefore those piles in each subdivision, and that the wall may be a sheet pile wall, a slurry trench wall or any suitable type of diaphragm wall and may be shaped as necessary. Either step of placing the pile means or the water impervious or wall means may precede the other, and under certain circumstances, both steps may be performed simultaneously.

There has thus been outlined rather broadly the more important features of the invention in order that the detailed description thereof that follows may be better understood, and in order that the present contributions to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions and practices as do not depart from the spirit and scope of the invention.

BRIEF DESCRIPTION OF THE DRAWING

Specific embodiments of the invention have been chosen for purposes of illustration and description, and are shown in the accompanying drawing forming a part of the specification wherein:

FIG. 1 illustrates a heavy load support on piles which extend through such a stratum;

FIG. 2 illustrates lateral movement of the load due to seismic shock and liquefaction of the upper stratum of soil;

FIG. 3 illustrates buckling of the supporting piles;

FIG. 4 illustrates a condition involving loss of friction capacity of the upper soil stratum and settling of the piles;

Referring now to FIG. 1, there is shown a load 10, such as a heavy building structure or the like, which is supported on a series of load supporting piles 11 extending from the base of the load down through a structure of soil 12 and into a load bearing level 14. The stratum 12 is a region of loose water bearing grannular soils having liquefaction potential, i.e., the potential for liquefying, if subjected to seismic shock.

FIG. 2 illustrates lateral movement of the load 10, in the direction of the arrow, as might occur under the conditions mentioned. Here, horizontal ground movements due to seismic shock shift the load laterally creating a certain momentum which induces very high lateral loads on the piles 11. If liquefaction of the stratum 12 also occurs, the passive soil pressures that normally resist lateral displacement are greatly decreased and very high bending movements are applied to the piles. In this connection it will be appreciated that the magnitude of the lateral forces that the piles must resist under such conditions is a function of the weight of the load so that the heavier the load, the heavier or stiffer the piles must be to resist such bending forces.

As shown in FIG. 3, if the stratum 12 liquifies for any reason, the lateral support of this soil for the piles 11 is greatly reduced or lost so that the piles tend to buckle under the axial load. Accordingly, where these conditions may exist, the piles must be designed to resist buckling.

Turning now to FIG. 4 a further possible condition is illustrated. Here, the upper stratum of soil 12 has liquified and lost its shear strength so that its frictional capacity along the upper portion of the piles 11 has been lost. The load 10 supported by the piles is transferred entirely down to the lower bearing soil 14, and this may well overstress the piles, the lower soil 14, or both, or it may cause settlement of friction type piles, and thus the supported load 10, as shown.

Figure 3:
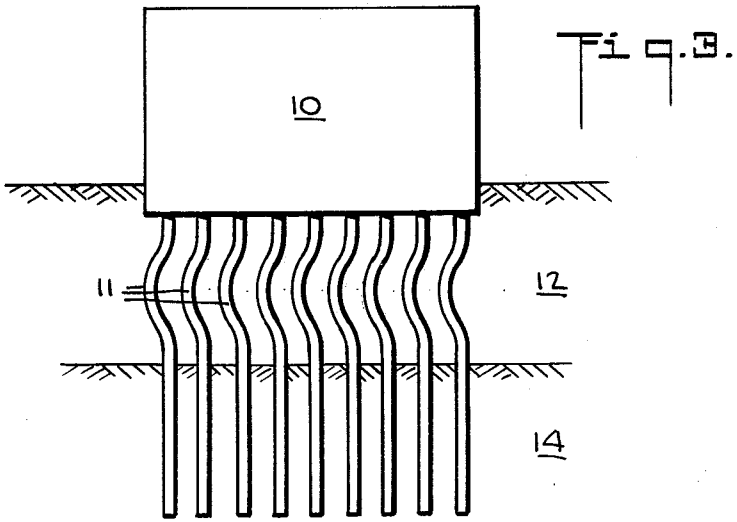
FIGS. 1 to 4 are schematic elevational views partly in section and illustrating the various difficulties mentioned above which could occur due to seismic shock occurring in a region wherein a heavy structure is supported on piles extending through an upper stratum of soil having liquefaction potential. Thus.
Figure 4:
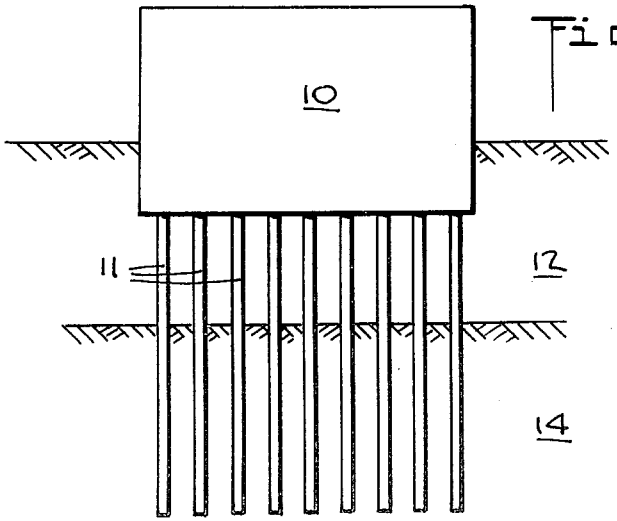
Figure 1:
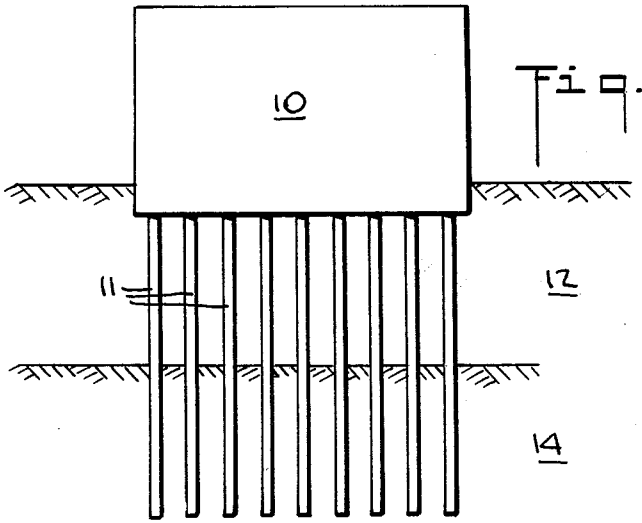
Figure 2:
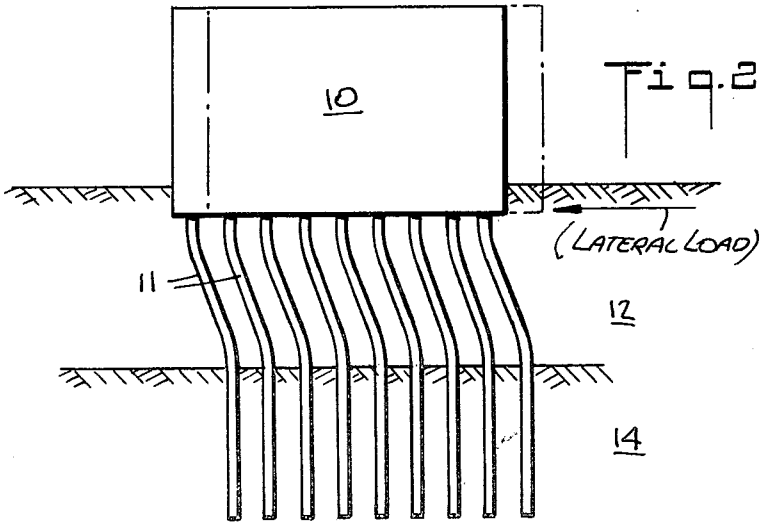
Figure 5:
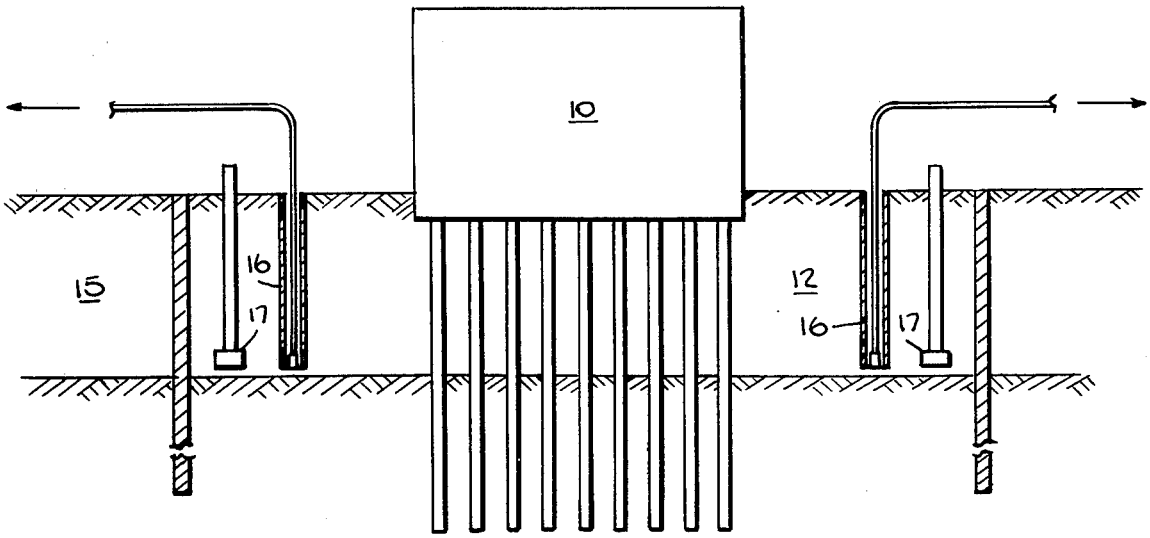
FIG. 5 is a view similar to FIG. 1 but which further illustrates one embodiment of the present invention.
Figure 6:
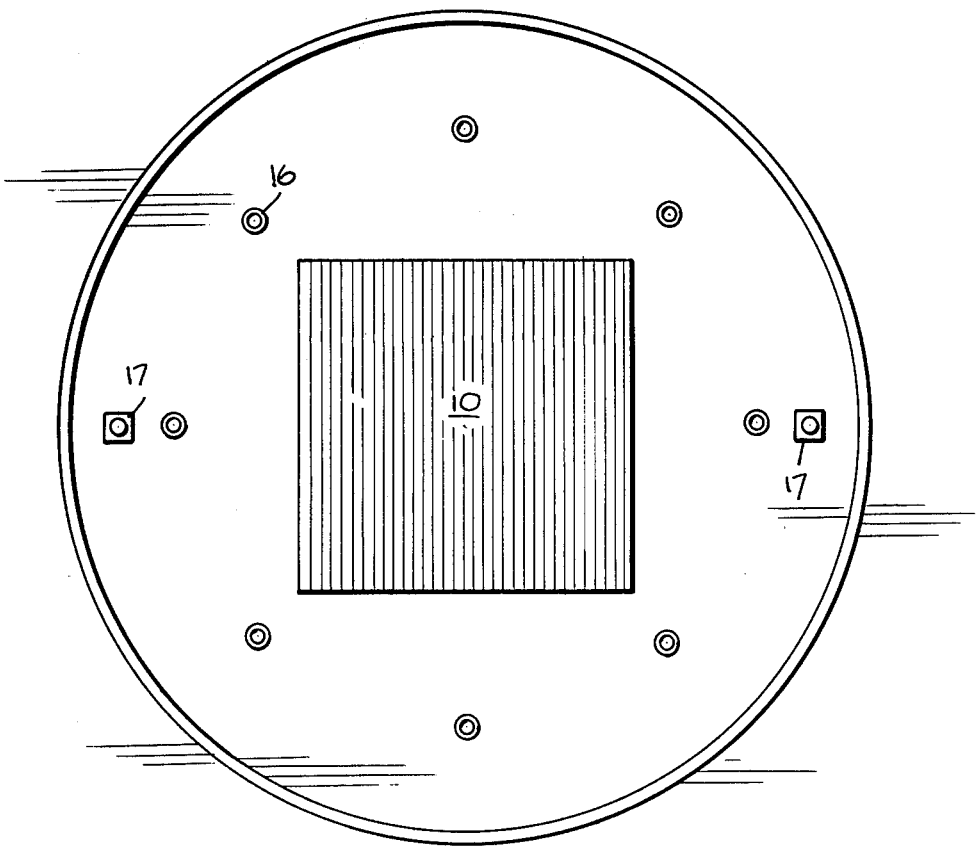
FIG. 6 is a top plan view of the structure of FIG. 5.

According to the present invention, and as illustrated in FIGS. 5 and 6, a number of load bearing piles 11, as required, are driven down through a stratum 12 of soil having liquefaction potential and into load bearing soil 14 to support a load 10. An endless wall 15 is formed around the piles and to a depth at least equal to the depth of the stratum 12, and preferably into a water impermeable stratum, as shown, and resists the flow of ground water into the region which it confines. The wall 15 may be a sheet pile wall, a slurry trench wall or any other type of wall suitable for substantial or complete ground water exclusion.

Means for dewatering the region confined by the wall 15 are placed as needed, and water is removed from the region to a degree sufficient to eliminate the liquefaction potential of the soil stratum 12 within the confines of the wall. The dewatering means may comprise well points, filter wells or other suitable means, the number, spacing and depth of which will vary according to soil conditions. It will be appreciated that certain physical conditions may limit the depth of suction wells, in which case deep well pumping systems could be used. Moreover, where the load is of large lateral dimensions, it may be necessary to extend the groundwater removal system under the structure.

In FIGS. 5 and 6 a filter well system is shown wherein a series of wells 16 are positioned in a circular pattern around the supported load 10 and its piles 11 and within the confines of the wall 15. One or more monitoring wells 17 may also be placed within the wall 15 to monitor the water level within the confined region so that when water within the region reaches a predetermined level or quantity, a signal reports the water condition and the dewatering system can be activated, or the monitoring signal can actuate the dewatering system directly, if desired.

As mentioned, if the structure realized from the foregoing process is sufficiently impervious to the flow of groundwater into the confined region, then the dewatering system need not be permanent and can be removed once the region is dewatered.

Depending on circumstances, a single wall may be formed to surround a region and all of the piles in the region or individual walls may be formed around subdivisions of the region and groups of piles in each subdivision.

Figure 7:
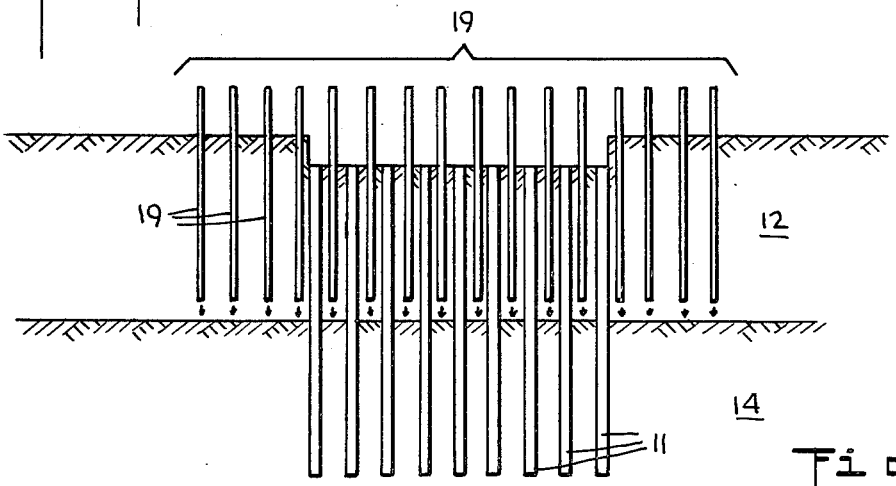
FIGS. 7 to 9 are elevational views partly in section illustrating a concept according to which another method is provided for stabilizing the soil having liquefaction potential.
Figure 8:
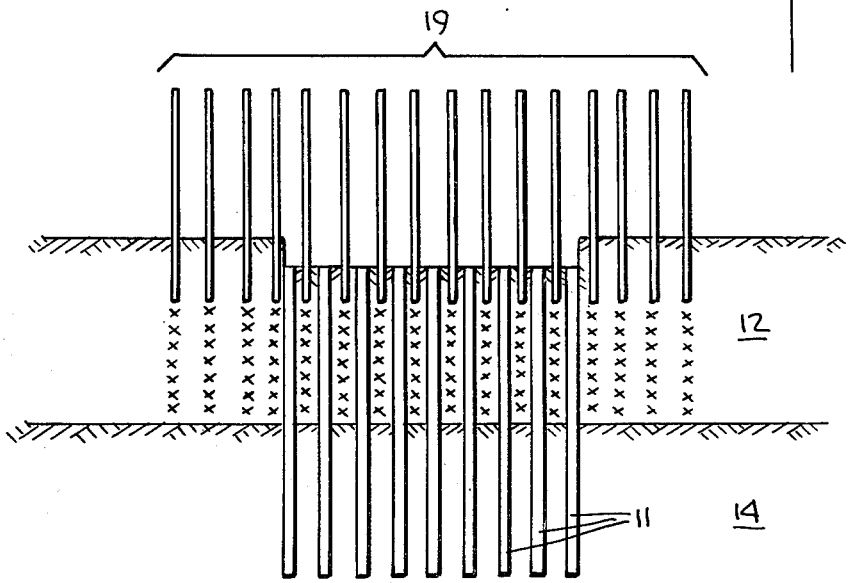
Figure 9:
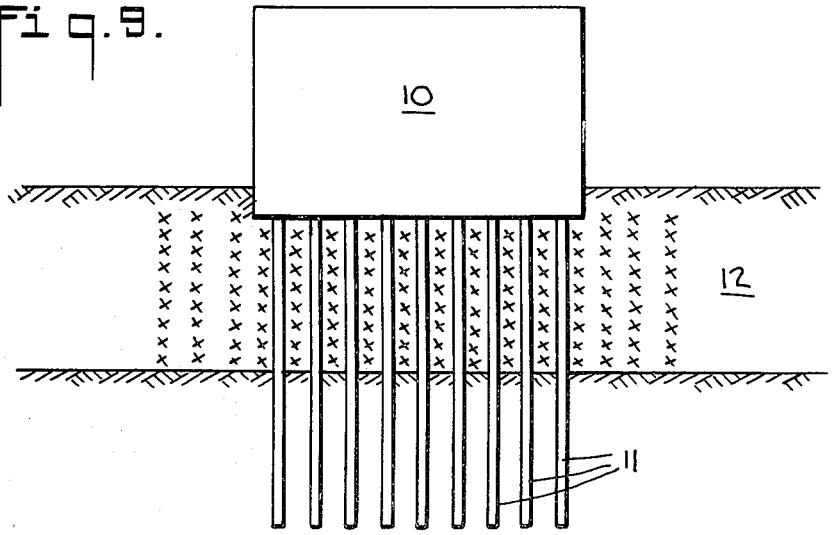

FIGS. 7 to 9 illustrate another method of stabilizing soil in a load bearing region according to which load bearing piles 11 are placed as already described with reference to FIGS. 5 and 6, for support of the load structure 10. The region 12 between and around the piles having liquefaction potential is cement or chemically grouted by a conventional one or two-stage grouting system using, for example, a silicate or other suitable substance for soil stabilization and elimination of liquefaction potential. It will be understood that the stabilization of the soils around the piles having liquefaction potential could be done by either chemical grouting or cement grouting. In chemical grouting, normally two different chemicals are injected into the soil simultaneously and when the chemicals mix, a chemical reaction takes place and a gel is formed. The chemicals in liquid form are pumped into the soil thus filling the spaces between the soil particles. When the gel forms, it bonds all of the soil particles together thus forming a solidified soil mass. Therefore, this action eliminates one of the conditions necessary for liquefaction to occur namely a loose granular soil. The ground water in the soil interstices may be displaced in whole or in part by the injected chemicals. Another method of grout stabilization is by the injection of a cement grout to fill the voids between the soil particles. The type of grout would harden or set, thus forming a solidified soil mass.

FIG. 7 illustrates a group of piles 11 placed to extend through stratum 12 and into load bearing soil 14. A series of pipes 19 are then inserted into the stratum 12 between and around the piles 11 and to a depth at least substantially equal to the depth of the stratum 12. As grout is pumped through the pipes 12, they are gradually withdrawn, as best shown in FIG. 8. The grout is pumped under a pressure not only to fill the volume formerly occupied by the pipes 19, but also to permeate the region between and around the piles 11. The load structure 10 may then be built on the piles 11, as shown in FIG. 9.

From the foregoing description it will be seen that by controlling or eliminating liquefaction potential piles may be used to support structures for which they are not now considered, reliance upon this frictional support of the soil throughout the pile length is realized so that shorter piles may be used for a given load, smaller and less costly piles may be used due to the ability to rely upon passive soil pressure to resist lateral displacement, and the lateral support or restraint of the soil may be relied upon to eliminate bending or buckling so that lower pile costs are possible.

I claim:

1. A method of stabilizing loose, water-bearing, granular soil having liquefaction potential in a pile bearing region, comprising: placing load support pile means in said region of soil to a depth at least to a load bearing level and at least equal to the depth of said soil having liquefaction potential, forming endless wall means in said region and to a depth at least equal to the depth of said soil having liquefaction potential to confine said region above said load bearing level and within said wall means and to resist the flow of ground water into said region, providing means for removing water from within the confines of said wall means and removing water from within the confines of said wall means substantially to dewater said soil to a degree sufficient to stabilize said soil having liquefaction potential to thereby provide additional support for said load bearing piles.

2. A method according to claim 1, wherein said endless wall means are formed to a depth to penetrate into a water impermeable stratum below said soil having liquefaction potential.

3. A method according to claim 1, wherein said pile means are driven to a depth to penetrate into a water impermeable stratum below said soil having liquefaction potential.

4. A method according to claim 1, wherein said pile means comprise a plurality of piles placed in said region and said wall means are formed to confine subdivisions of said region and the groups of piles in each subdivision.

5. A method according to claim 1, including the step of positioning monitoring means and water withdrawing means in said region to monitor the amount of water therein and withdraw water from said region when the amount of water therein exceeds a predetermined level or quantity thus to maintain said region free of liquefaction potential.

6. A method according to claim 5, wherein said monitoring means controls said water withdrawing means.

* * * * *